US007962056B2

(12) United States Patent
Masubuchi et al.

(10) Patent No.: US 7,962,056 B2
(45) Date of Patent: Jun. 14, 2011

(54) METHOD AND APPARATUS FOR SPEED CHANGE DETECTION BASED ON A LATENT IMAGE PATTERN

(75) Inventors: Fumihito Masubuchi, Ebina (JP); Shinji Kato, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 746 days.

(21) Appl. No.: 12/003,293

(22) Filed: Dec. 21, 2007

(65) Prior Publication Data

US 2008/0150543 A1 Jun. 26, 2008

(30) Foreign Application Priority Data

Dec. 25, 2006 (JP) ..... 2006-348644
Mar. 16, 2007 (JP) ..... 2007-068564

(51) Int. Cl.
*G03G 15/00* (2006.01)

(52) U.S. Cl. ..... 399/48; 399/49

(58) Field of Classification Search ..... 399/36, 399/48, 49, 167
See application file for complete search history.

(56) References Cited

U.S. PATENT DOCUMENTS

| | | | | |
|---|---|---|---|---|
| 5,493,382 | A | 2/1996 | Takagaki et al. | |
| 5,604,575 | A | 2/1997 | Takagaki et al. | |
| 5,737,680 | A | 4/1998 | Takagaki et al. | |
| 6,798,996 | B2 | 9/2004 | Sawada et al. | |
| 7,149,449 | B2 * | 12/2006 | Kietzman et al. | 399/68 |
| 2007/0065164 | A1 | 3/2007 | Fujimori et al. | |

FOREIGN PATENT DOCUMENTS

| | | |
|---|---|---|
| JP | 09-146329 | 6/1997 |
| JP | 2004-069843 | 3/2004 |
| JP | 2005-010680 | 1/2005 |
| JP | 2005-017768 | 1/2005 |
| JP | 2005-092131 | 4/2005 |
| JP | 2005-338835 | 12/2005 |

* cited by examiner

*Primary Examiner* — William J Royer
(74) *Attorney, Agent, or Firm* — Harness, Dickey & Pierce, P.L.C.

(57) ABSTRACT

A speed change detection apparatus includes an image carrier for carrying a latent image, and a latent image pattern forming device for forming a latent pattern image on the image carrier. The pattern image includes periodically formed line or dot images. An alternating current conversion type surface potential sensor is provided to detect a potential of the surface of the photoconductive member. The alternating current conversion type surface potential sensor further detects a change in speed of the image carrier by detecting a moiré appearing on the latent image pattern.

7 Claims, 5 Drawing Sheets

METHOD AND APPARATUS FOR SPEED CHANGE DETECTION BASED ON A LATENT IMAGE PATTERN

CROSS REFERENCE TO RELATED APPLICATIONS

This application claims priority under 35 USC §119 to Japanese Patent Application Nos. 2006-348644, filed on Dec. 25, 2006, and 2007-068564, filed on Mar. 16, 2007, the entire contents of which are herein incorporated by reference.

BACKGROUND OF THE INVENTION

1. Field of the Invention

The present invention relates to a technology of detecting a periodic change in speed of a latent image carrier included in an image forming apparatus.

2. Discussion of the Background Art

In an image forming apparatus employing an electrophotographic system, such as a copier, a printer, a facsimile, a duplicator, and the like, as one of abnormal images caused by a driving and conveying mechanism, a banding phenomenon is exemplified, which causes unevenness of density in a band state periodically or at random in a sub scanning direction.

A mechanism of an occurrence of the banding phenomenon is initially described. There usually exists a vibration source in a driving system for driving a polygon mirror, a developing apparatus, and a fixing apparatus. Also driven by the driving system are a photoconductive member, a transfer member, such as a transfer conveyance belt, and an intermediate transfer belt, and the like The vibration travels from the vibration source toward the photoconductive member or the transfer member, thereby, density unevenness likely occurs at any one of exposing, developing, and transferring steps.

As a countermeasure against such problem, it is essentially most efficient to suppress vibration transmitted to the photoconductive member or the transfer member. Especially, the vibration arrived at the photoconductive member is needed most to be reduced, because it creates a change in speed and can be a cause of banding at all of the steps of the exposing, developing, and transferring.

To reduce the change in speed of the photoconductive member, it is needed to know a type of a speed change as a first thing. Conventionally, the speed change is generally known by either attaching a rotary encoder to a driving shaft of the photoconductive member or arranging marks on one end of the photoconductive member at a constant interval and detecting the marks with an optical sensor or the like. That is, the one end is used as an encoder in the latter situation. Such a system is indeed capable of wide range detecting from low to high frequencies of a speed change of the photoconductive member. However, the system is costly, because the encoder needs a high-resolution for detecting a high frequency change in speed.

The Japanese Patent Application Laid Open No. 2005-338835 discusses a method capable of detecting a high frequency (i.e., a short cycle) of a speed change with a simple sensor. Technically speaking, the method rather detects just banding and not the speed change of the photoconductive member.

Further, the Japanese Patent Application Laid Open No. 2005-17768 discusses an image forming apparatus that is capable of detecting a periodical speed change of a photoconductive drum using latent image patterns.

However, the method of the Japanese Patent Application Laid Open No. 2005-338835 needs to spend toner per detection, because an optical sensor provided needs to detect a visualized image, such as a toner image, and the like Whereas in the Japanese Patent Application Laid Open No. 2005-17768, there is no such problems of spending the toner for the purpose of detection, because they use the latent image patterns. However, since speed change during a relatively long cycle such as one rotation cycle of a drum is a detection objective, a pattern latent image including a number of lines is depicted over one cycle of the speed change and then detects a fineness of an interval of the pattern. Further, a latent image detection device needs a high resolution when detecting a speed change of a short cycle, such as high frequency banding, and the like

SUMMARY OF THE INVENTION

Accordingly, an object of the present invention is to improve such background arts technologies and provides a new and novel speed change detection apparatus. Such a new and novel speed change detection apparatus includes an image carrier for carrying a latent image, and a latent image pattern forming device for forming a latent pattern image on the image carrier. The latent pattern image includes periodically formed line or dot images. An alternating current conversion type surface potential sensor is provided to detect a potential of a surface of the image carrier. The alternating current conversion type surface potential sensor further detects a change in speed of the image carrier by detecting a moiré appearing on the latent pattern image.

In another embodiment, a cycle of the periodically formed line or dot images is set in the vicinity of a known vibration cycle of the image carrier.

In yet another embodiment, the latent pattern image is successively formed by gradually changing a cycle of the periodically formed line or dot images.

In yet another embodiment, each of said line images extends in a main scanning direction, said line images making a line in the sub-scanning direction.

In yet another embodiment, an image forming apparatus includes an image carrier for carrying a latent image, an image formation device for forming the latent image on the image carrier, and the speed change detection apparatus.

In yet another embodiment, a vibration creating device is provided to create a prescribed vibration having a phase opposite to a periodic speed change of the image carrier detected by the speed change detection apparatus.

In yet another embodiment, a method for detecting a periodic change in speed of a image carrier includes the steps of forming a periodic latent image pattern on an image carrier, providing an alternating current conversion type surface potential sensor, detecting moiré appearing on the latent image pattern using the alternating current conversion type surface potential sensor, and detecting the periodic latent image pattern based on the step of detecting the moiré.

BRIEF DESCRIPTION OF DRAWINGS

Amore complete appreciation of the present invention and many of the attendant advantages thereof will be readily obtained as the same becomes better understood by reference to the following detailed description when considered in connection with the accompanying drawings, wherein.

PREFERRED EMBODIMENTS OF THE PRESENT INVENTION

Figure 1:
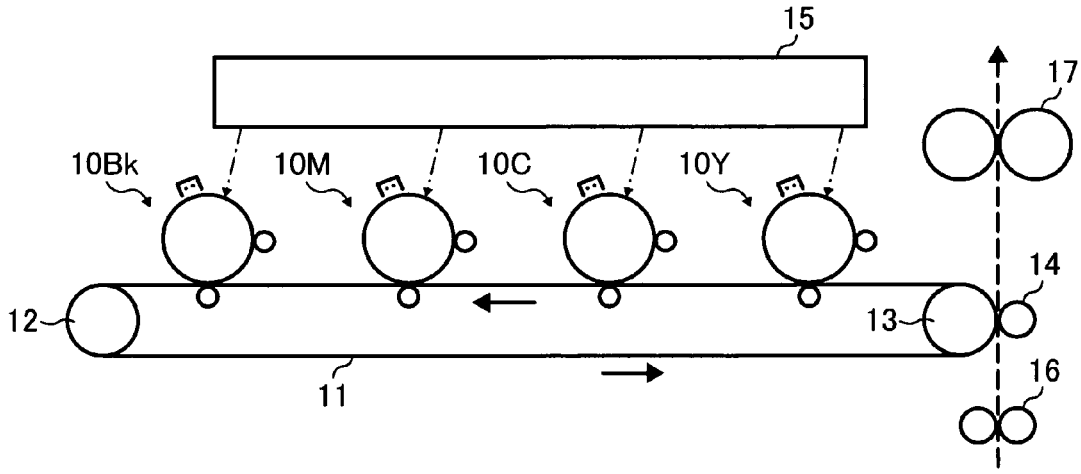
FIG. 1 illustrates an exemplary image formation section of an image forming apparatus employing a speed change detection apparatus and surrounding thereof according to the present invention.

Referring now to the drawings, wherein like reference numerals designate identical or corresponding parts throughout several views. According to a recently mainstream digital electrophotographic apparatus, a halftone image is formed by dots and lines arranged at a certain interval. In an exposure step in such an apparatus, a cycle or a width of a dot or a line changes on a latent image due to a periodic change in speed of a photoconductive member, and thereby banding is visually recognized after a development step.

When a pattern is periodically formed with a dot or a line, and the cycle thereof is close to that of the speed change, a density change called moiré seemingly appears by a cycle longer than that of the original speed change of the photoconductive member. This phenomenon similarly appears both on toner and latent images. When the moiré appearing on the latent image is read with a surface potential sensor having a commercially available resolution, such as about 2 to 5 mm, as currently used in an image forming apparatus, a speed change at a cycle less than 1 mm can be detected.

Almost all of cycles of vibration that causes the speed change are known, such as a resonant frequency of a housing or a pitch of a gear or the like. Accordingly, it is preferable to set a cycle of a periodic pattern in the vicinity of the cycle of the known vibration (i.e., a speed change).

When cycles of a plurality of different speed changes are known, it is preferable to prepare and arrange a plurality of different cycle patterns sequentially in accordance with the respective cycles of the speed change. Typically, a periodic pattern is effectively formed by arranging latent line images extending in a main scanning direction in the sub scanning direction at a constant interval.

Now, an exemplary embodiment of the present invention is more specifically described with reference to several drawings, in particular in FIG. 1, an image formation section included in an image forming apparatus having a speed change detection device and surroundings are described according to one embodiment of the present invention. Although the present invention is herein after described using a multi color image forming apparatus of a tandem drum type using an intermediate transfer system, in which a plurality of image bearers (photoconductive members) are arranged along an intermediate transfer belt, the other type of an image forming apparatus, such as a direct transfer system, can be employed. For example, the photoconductive member can be a belt.

As shown in FIG. 1, four image forming units 10 (Y, C, M, and Bk) are successively arranged along an upper run of an intermediate transfer belt 11. The intermediate transfer belt 11 wound around supporting rollers 12 and 13 is driven counterclockwise in the drawing. The supporting roller 13 on the right side is a transfer opposing roller. Opposing the supporting roller 13, a secondary transfer roller 14 pressure contacts the supporting roller 13 via the intermediate transfer belt 11.

Figure 2:
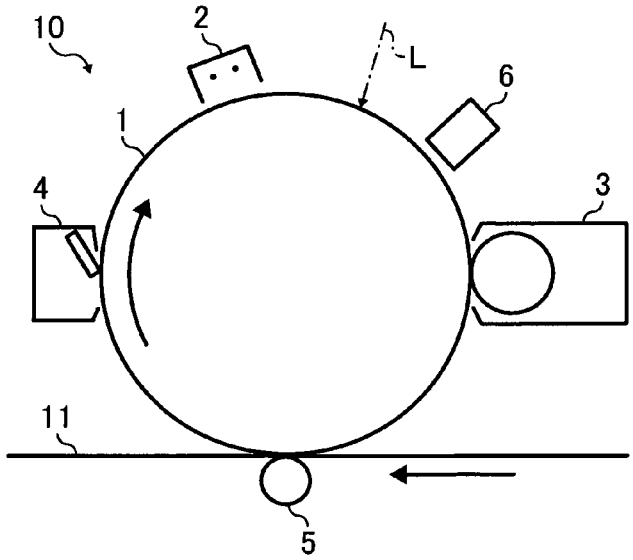
FIG. 2 is an enlarged view illustrating an image forming unit included in the image forming apparatus of FIG. 1.

Respective image forming units 10 have the same configuration and are only different from each other by color of toner to handle. As specifically illustrated in FIG. 2, a photoconductive drum 1 is arranged as an image bearer. Around the photoconductive drum 1, a discharge device 2, a developing device 3, and a cleaning device 4 or the like are arranged. Further, almost opposing the respective photoconductive drums 1, transfer rollers 5 as a primary transfer device are arranged inside the intermediate transfer belt 11. A surface potential sensor 6 mentioned later in detail is arranged downstream of a writing position, to which a scanning light L is emitted, and upstream of the developing device 3 in a rotational direction of the photoconductive drum 1 driven clockwise.

Above the four image forming units 10, an optical writing apparatus 15 is arranged. When a laser exposure apparatus is used as the optical writing apparatus 15, a laser light optically modulated is emitted onto the surface of the photoconductive drums 1 of respective image forming units 10 via a polygon mirror and a mirror group or the like.

A registration roller 16 is arranged upstream of the secondary transfer section at which the supporting roller 13 opposes the secondary transfer roller 14. Above the secondary transfer section, a fixing apparatus 17 is arranged. As a fixing apparatus, a belt type can be used beside a heat roll type as shown in the drawing. Further, an induction heating system can be employed beside a heater heat applying system.

Now, an exemplary image formation operation executed in the above-mentioned image forming apparatus is briefly described. The photoconductive drum 1 of the image forming unit 10 is driven and rotated clockwise by a driving device, not shown, and is uniformly discharged at its surface with charge in a prescribed polarity. On the surface of the photoconductive drum 1 carrying the charge, a scanning light is emitted from the optical writing apparatus 15, thereby a latent image is formed thereon. The surface potential sensor 6 detects a potential of the latent image, and the developing device 3 applies toner to visualize the latent image into a toner image. Image information included in an exposure light to the respective photoconductive drum 1 in the image forming units 10 includes monochrome image information obtained by dividing a prescribed full-color image into Yellow, Magenta, Cyan, and Black color information.

Further, the intermediate transfer belt 11 is driven counterclockwise as shown, and receives and overlays respective of the mono color toner images from the photoconductive drums 1 by functions of the primary transfer rollers 5 in the respective image forming units 10. In this way, the intermediate transfer belt 11 carries the full color toner image on its surface.

Further, a single color image can be formed using one of the image forming units 10. Two or more color images can be also formed selectively using two or more image forming units 10. A monochrome print can be created by using the black unit 10Bk among the four.

Then, remaining toner sticking to the surface of the photoconductive drum 1 after the transfer of the toner image is removed by the cleaning device 4 from the surface. Then, the surface is subjected to a charge removing device, not shown, and the surface potential is initialized. Thus, the photoconductive drum 1 is prepared for the next image formation.

A sheet is fed from a sheet feeding tray, not shown, and is further fed by the pair of registration rollers 16 toward the secondary transfer position in synchronism with a toner image carried on the intermediate transfer belt 11. The secondary transfer roller 14 receives a transfer voltage of a polarity opposite to a discharge polarity of the toner image on the surface of the intermediate transfer belt 11. Thus, toner images on the surface of the intermediate transfer belt 11 is transferred onto the sheet at once. When the sheet carrying the toner image passes through the fixing apparatus 17, the toner is fused and fixed thereinto by heat and pressure. The sheet carrying the fixed toner image is then ejected onto a sheet ejection tray, not shown.

The surface potential sensor 6 detects a potential of the surface of the photoconductive drum 1 after the exposure. The detection result is used by the discharge device 2 and the exposure device (i.e., a writing apparatus) to correct discharge and exposure amounts respectively. For correction, a rectangular solid pattern having a square of 1 cm to 2 cm is used.

Figure 3:
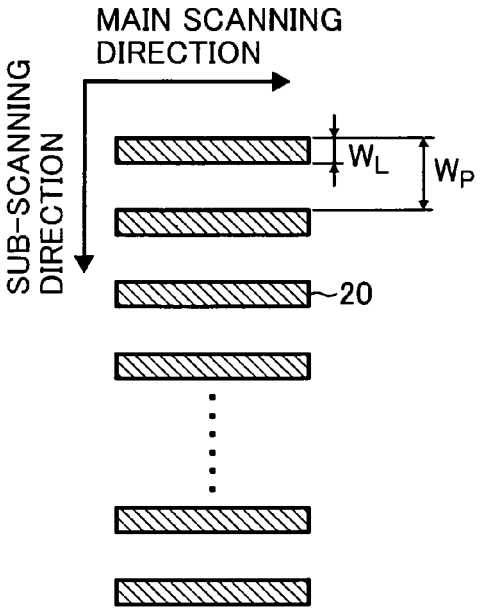
FIG. 3 illustrates exemplary latent image patterns employed to detect photoconductive member speed change.

In this embodiment, the surface potential sensor 6 is also used to detect a change in speed of a photoconductive drum 1. Thus, a latent image pattern shown in FIG. 3 is used. Specifically, line images 20 extending in the main scanning direction make a line in the sub-scanning direction. This can be a type of a line screen pattern. When a cycle of repetition of lines Wp is nearly equal to that of a change in speed of a photoconductive drum Wv, a moiré appears with a cycle few to several dozen times longer than that of a change in original speed. However, moiré does not appear when $W_v$ is equal to $W_p$.

The cause of the appearance of the moiré in the exposure device can be understood when geometrically considered as described below.

First, an occurrence of banding not accompanied by moiré is considered. When exposure of raster scanning of a laser beam is executed and a speed of the raster scan changes in a sub-scanning direction by 10%, a line width WL, of one dot does not change more than 1%, whereas a line repetition cycle Wp changes by 10%. Because, the Wp is simply in proportion to a speed of the photoconductive drum in the sub-scanning direction. Accordingly, when the speed of the photoconductive drum changes in the sub-scanning direction, an interval between the lines varies. The above-mentioned cycle and width represent a length in the sub-scanning direction. For example, when a halftone image is outputted using a lateral line screen pattern of a one-dot line, only the interval varies maintaining the line width WL, and as a result, density changes and banding appears when viewed from remote.

When the lateral line screen pattern is constituted by a fat line of more than two dots, the line width WL also varies in the sub-scanning direction due to the speed change. When a rate of a changing amount from an original length in relation to the original length is supposed to represent a changing rate, the changing rate of the line width WL increases and approaches a changing rate of the line repetition cycle WP as the number of dots constituting the line increases. Thus, when a change in speed in the sub scanning direction has the same amplitude, a density change of the lateral line screen pattern constituted by the one dot is most significant, and a density change thereof becomes small as the line width increases such as two to four dots.

Now, moiré is described. The Moiré is a kind of so-called buzz. Specifically, it is a phenomenon visually recognized as a density change corresponding to a difference between two different space frequencies when image patterns of such different space frequencies are provided. Accordingly, the moiré can highly likely be recognized even when a line repetition cycle Wp of a lateral line screen pattern is optionally chosen. However, the moiré has been actually recognized only when the above-mentioned Wv is nearly equal to the Wp. The reason for this can be that an average of speed changes occurring during the line repetition cycle Wp almost becomes a prescribed average level only in this situation. Where as, since the line repetition cycle Wp does not change and the line width WL becomes shorter than the speed change cycle Wv, the speed changes even if the speeds during the line width WL are averaged. The line width WL also changes. Thus, density likely significantly changes as the banding occurs in the lateral line screen pattern of one dot line as mentioned above.

When the speed change cycle Wv is known, the line repetition cycle Wp preferably ranges in the vicinity and preferably within about ±20% of the speed changing cycle Wv, so that a cycle of the moiré can be detected by the surface potential sensor. As for the line width WL, since it is relatively shorter in comparison with the speed change cycle Wv, the line width WL is preferably less than ½ only as a guide.

Figure 4:
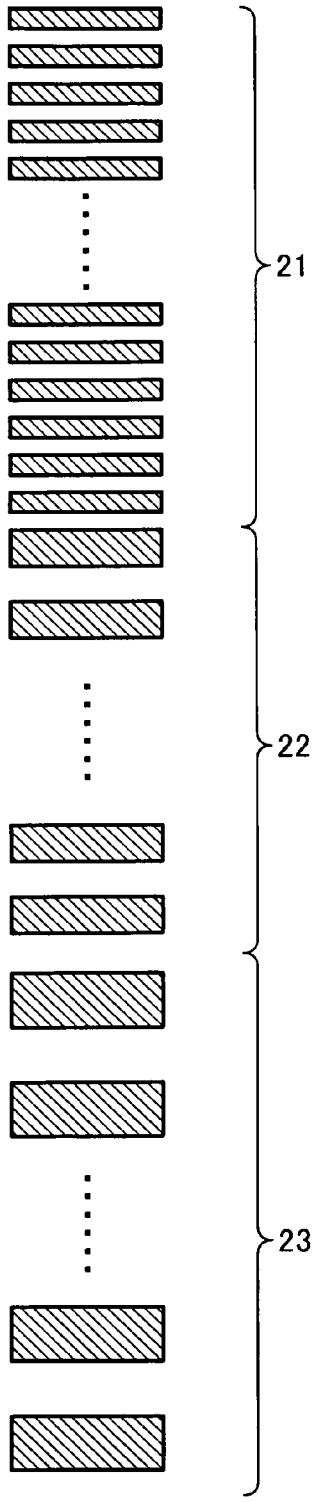
FIG. 4 illustrates an exemplary model of a latent image pattern, in which plural lines of a line latent image extending in a main scanning direction are arranged in a sub scanning direction.

When there exist a plurality of known speed change cycles Wv, latent image patterns having line repetition cycle Wp are needed corresponding to the respective speed changing cycles Wc. Then, it is effective if these are arranged step by step along the sub-scanning direction as shown in FIG. 4. Although only latent image patterns 21 to 23 are exemplified corresponding to a number of types of speed changing cycles Wv as in FIG. 4, a number of the types other than three can be used.

In order to find out unknown speed changing cycles Wv, latent image patterns like FIG. 4 are gradually changed to cover all. In such a situation, the line repetition cycle Wp is seamlessly changed.

By detecting the moiré with the above-mentioned manner, the speed changing cycle Wv can initially be defined. The amplitude of the speed change can also be defined by a conversion formula based upon the above-mentioned theory. However, the conversion formula is preferably used after obtaining a performance curvature based on a comparison with another speed change detecting system (e.g. a rotary encoder). Because, a relation between a practical moiré and such an amplitude of a speed change is affected also by an amount of overlapping of scanning lines and a difference in performance of developing processes.

A cycle and an amplitude of the speed change thus sought can be used in checking a performance at a time of development or manufacturing Further, when a speed change is periodic and is highly reproducible, the speed change is reduced by installing a vibration generator in an image forming apparatus and generating vibration having a reverse phase. Thus, banding possibly occurring in each of the steps of the exposure, development, and transfer due to speed change of the photoconductive member can be reduced.

Since the surface potential sensor is mounted for the purpose of detecting potentials of a charge and a latent image formed on an electrophotographic photoconductive member, the surface potential sensor can detect periodic speed change of the photoconductive member at the same time. As a result, a special sensor is not additionally needed. Further, toner to form a toner mark or the like is not consumed. Accordingly, a periodic speed change of the photoconductive member can highly precisely be detected at low cost.

Figure 5:
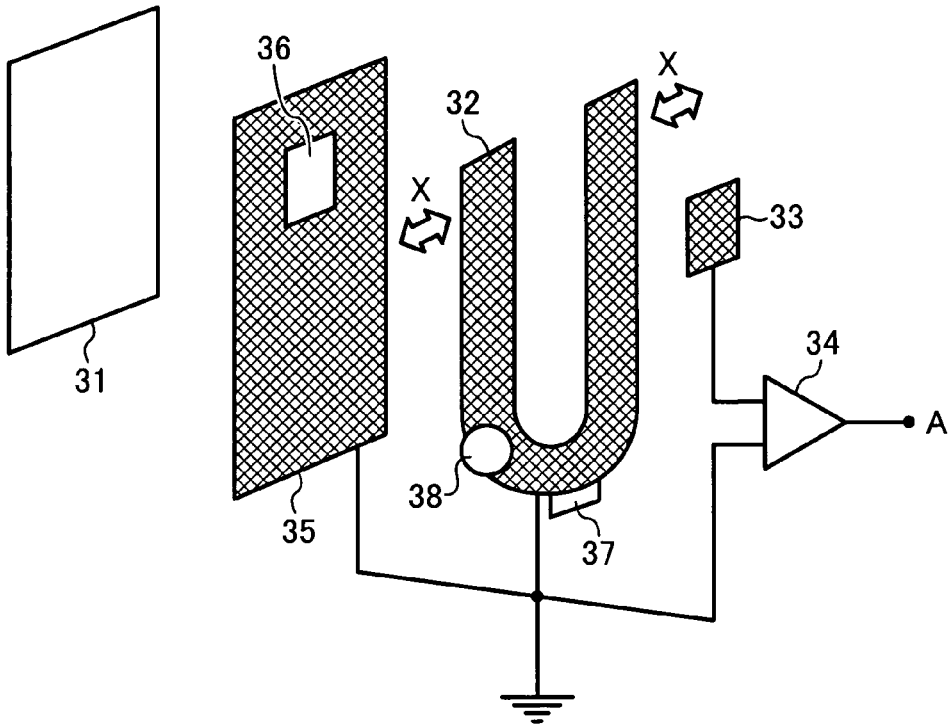
FIG. 5 illustrates an exemplary model of an alternating current conversion type surface potential sensor.

Now, an alternating current conversion type surface potential sensor is described with reference to FIG. 5. As shown, numeral number 31 denotes a detection objective, such as a photoconductive member having charge on its surface, and the like. Numeral number 32 denotes a chopper including a tuning fork type oscillator that executes chopping while vibrating an electrical flux line entered from the detection objective 31 to a detection electrode 33 in a direction X. Numeral number 34 denotes a preamplifier that applies impedance conversion to a minute alternating current signal induced at the detection electrode 33. The preamplifier 34 then amplifies and outputs the conversion result to a terminal A as a detection output. 35 denotes a shield case with a window 36 for permitting the electric flux irradiated from the detection objective 31. The shield case 35 is depicted in a plate like shape in the drawing for the purpose of ease, but is actually shaped like a box or a can to install the chopper 32 or the detection electrode 33, or the like. 37 denotes a piezoelectric element vibrated by a driving source, not shown, to causes the chopper 32 to vibrate in the X direction. 38 denotes a temperature sensor attached to the chopper 32 to detect temperature of the chopper 32. The temperature sensor 38 is not necessarily attached contacting the chopper 32 as there shown, and can be apart from the chopper 32 but in the vicinity thereof.

When the detection objective 31 is to be detected by the surface potential sensor, the surface potential sensor is attached to such a position that a distance between the window 36 of the shield case 35 and the detection objective 31 amounts to a few mm. When the detection objective 31 is charged, an electric filed extends to the detection electrode 33 via the window 36 of the shield case 35 and the chopper 32, while the shield case 35 and the chopper 32 are maintained grounded. The chopper 32 vibrates at a prescribed frequency in the X direction owing to vibration of the piezoelectric element 37 so as to open and close a route of the electric field. By this opening and closing, an alternating current wave is outputted from the detection electrode 33 to the output terminal A via the amplifier 34 as shown in FIG. 6.

Figure 6:
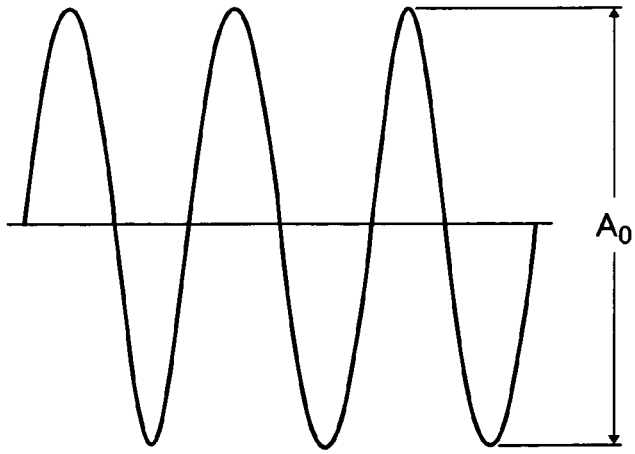
FIG. 6 illustrates an exemplary output waveform appearing in the potential sensor of FIG. 5.

The amplitude Ao of the alternating current wave of FIG. 6 depends on three variable parameters, such as a surface potential Ve of the detection objective 31, a detection distance d defined by a distance from the surface of the detection objective 31 to the detection electrode 33, and a vibration amplitude S of the chopper 32. Accordingly, the detection distance d and the vibration amplitude S are necessarily known when detecting the surface potential Ve. Thus, the amplitude Ao is used to detect the surface potential Ve, after applying correction to the Ve while keeping each of the detection distance d and the vibration amplitude S at a constant level, with the conditions of the distance d and the vibration amplitude S.

Reversely, the detection distance d can be calculated based on the detection output (i.e., an amplitude Ao), if the vibration amplitude S is constant and the surface potential Ve of the detection objective 31 is known. Specifically, the surface potential Ve of the detection objective 31 is previously detected in a prescribed manner. For example, if at least the surface of the detection objective 31 is conductive and is capable of contacting a voltage detector, a surface potential Ve can be known. Even if the surface of the detection objective 31 is in a floating condition, the surface potential Ve can be known independent from the detection distance d if detected with the alternating current conversion type surface potential sensor in corporation with the later mentioned feedback control.

The vibration amplitude S possibly varies in accordance with a temperature change of the chopper 32. However, correction of the variation can be made by using material having a low expansion coefficient for the chopper 32, for example. Otherwise, an actuator output for driving the chopper 32 can be corrected to control the amplitude to be constant by detecting temperature of the chopper 32 with the temperature sensor 38 and predicting the vibration amplitude S based thereon. In addition, since the amplitude Ao is in proportion to the vibration amplitude S, the detection distance d is calculated after dividing the amplitude Ao with the vibration amplitude S.

Figure 7:
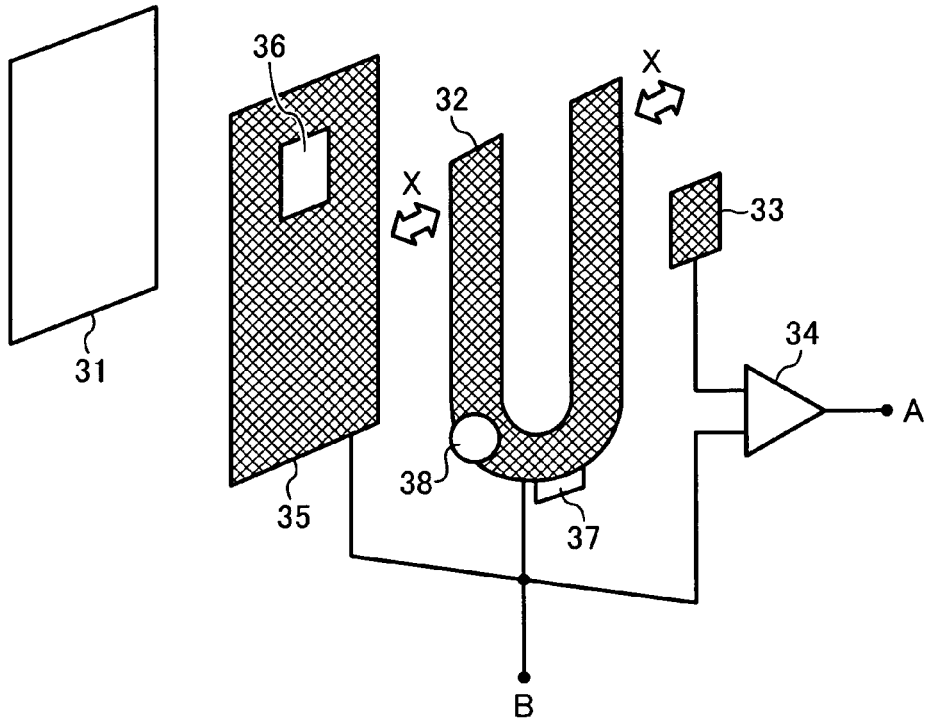
FIG. 7 illustrates an exemplary alternating current conversion type surface potential sensor with a feedback control.
Figure 8:
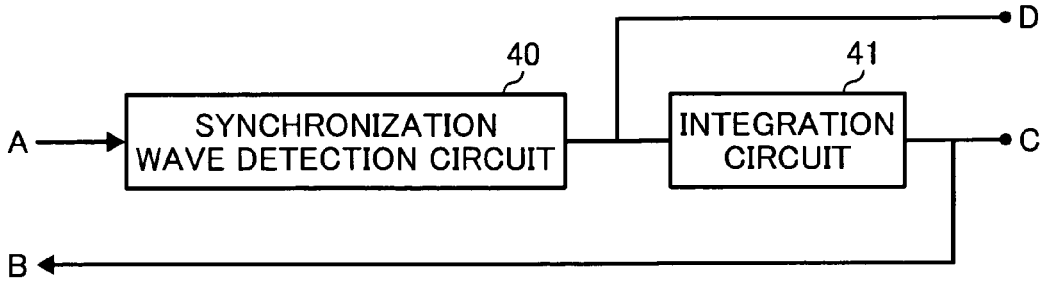
FIG. 8 illustrates an exemplary feedback circuit.

Now, an exemplary configuration of the alternating current conversion type surface potential sensor that operates in corporation with feedback control is described with reference to FIGS. 7 and 8. When compared with FIG. 5, the alternating current conversion type surface potential sensor is apparently different from that in FIG. 5 by the following aspects. That is, the shield case 35, the chopper 32 and the preamplifier 34 are separated from ground to be in a floating state, and are connected to a terminal B. Further, the terminal B is connected to a signal line to execute feedback as shown in FIG. 8.

Specifically, as shown there, the detection output Ao is extracted by a synchronization wave detection circuit 40 based on a signal wave of a terminal A, is output to terminal D and is fed back to the terminal B via an integration circuit 41. The potential of the feedback gradually approaches the potential Ve, because the output Ao is in proportion to a difference between the potential Ve of the detection objective 31 and that of the terminal B. Then, the potential of the terminal C serves a real surface potential Ve of the detection objective 31, when the potential of the feedback sufficiently approaches the potential Ve. Since the output Ao becomes almost zero, the value Ve is not substantially affected even if the vibration amplitude S and the distance d change. Accordingly, by using the alternating current conversion type surface potential sensor with the feedback control, a real surface potential can be detected regardless of the vibration amplitude S and the distance d.

The alternating current conversion type surface potential sensor with a feedback control is generally maintained in a floating condition and feedback is executed from a high voltage amplifier section that employs an insulation transducer.

Figure 9:
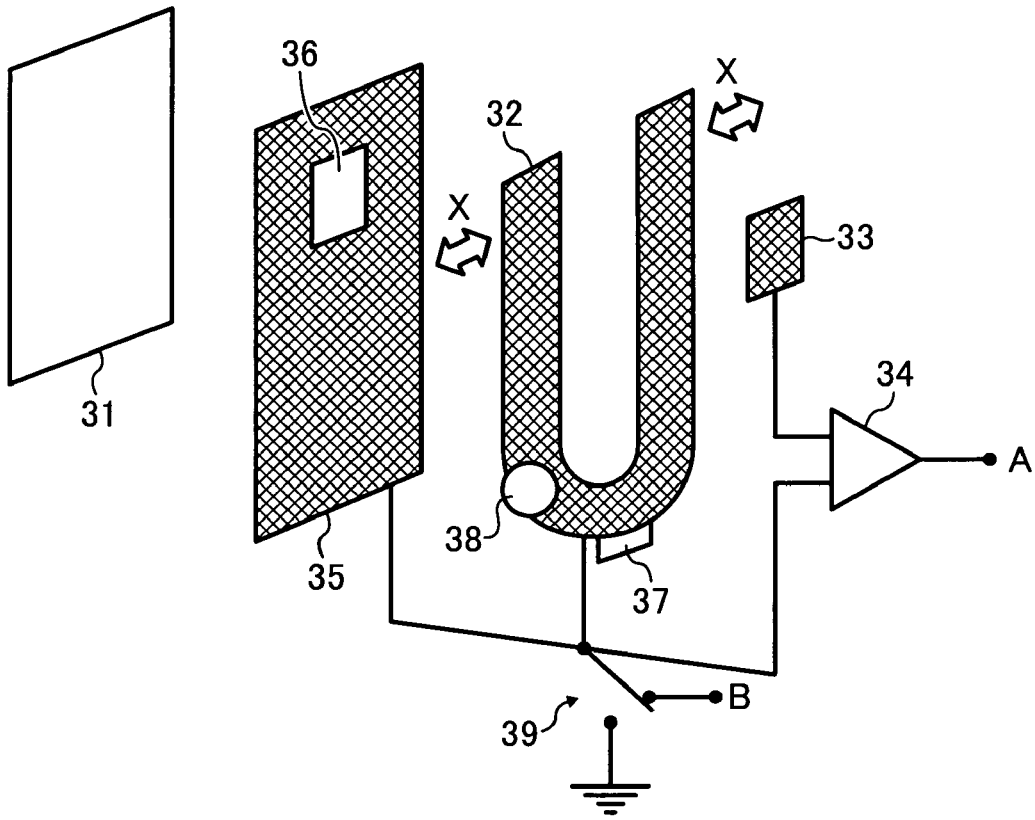
FIG. 9 illustrates an exemplary alternating current conversion type surface potential sensor capable of selectively using the feedback control.

Now, an exemplary configuration of an alternating current conversion type surface potential sensor that is optionally executing a feedback control is described with reference to FIG. 9. As shown, a switch 39 is provided to selectively connect the shield case 35 and the chopper 32 with the terminal B or ground. The rest of the above-mentioned devices are the same to those in the embodiment described with reference to FIG. 7.

The above-mentioned alternating current conversion type surface potential sensor has such an advantage that a change in temperature or distance of a detection objective hardly affects a potential detection value different from the other systems. Thus, it is widely utilized in many industrial fields, such as an electrophotographic duplicator, and the like. In contrast, due to such a defect that an area resolution is low, such as 3 to 5 mm when a surface potential sensor of a feedback system is used, a fine change in density or potential, such as banding, and the like, cannot be detected.

According to one example of the present invention, by detecting moiré of a latent image with the alternating current conversion type surface potential sensor as mentioned with reference to FIGS. 3 and 4, a speed change of the photoconductive member with a high frequency can be detected without: a detection device having high resolution. Further, a speed change detection device and an image forming apparatus including the speed change detection device can be obtained at low cost while preventing waste of toner.

The above-mentioned alternating current conversion type surface potential sensor is just one example, and can be another type. The above-mentioned latent image pattern is only one example, and various modifications are possible. For example, a size, a shape, a number of repetition times, and a cycle of the latent image can be optionally set in accordance with a detection objective.

The above-mentioned image forming apparatus is only one example, and a direct transfer system can be employed. Further, a belt type latent image carrier can be employed rather than the above-mentioned drum type. Another type of a printer, a copier, a facsimile, or a multifunctional machine can be used as an image forming apparatus.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A speed change detection apparatus, comprising:

an image carrier configured to carry a latent image;

a latent image pattern forming device configured to form a latent pattern image on the image carrier, said latent pattern image including periodically formed line or dot images; and an alternating current conversion type surface potential sensor configured to detect a potential of a surface of the photoconductive member;

wherein said alternating current conversion type surface potential sensor further detects a change in speed of the image carrier by detecting a moiré appearing on the latent pattern image.

2. The speed change detection apparatus as claimed in claim 1, wherein a cycle of the periodically formed line or dot images is set in the vicinity of a known vibration cycle of the image carrier.

3. The speed change detection apparatus as claimed in claim 1, wherein said latent pattern image is successively formed by gradually changing a cycle of the periodically formed line or dot images.

4. The speed change detection apparatus as claimed in claim 3, wherein each of said line images extend in a main scanning direction, said line images making a line in the sub-scanning direction.

5. An image forming apparatus comprising:

an image formation device configured to form the latent image on the image carrier; and the speed change detection apparatus as claimed in claim 1.

6. The image forming apparatus as claimed in claim 5, further comprising a vibration creating device configured to create a prescribed vibration, wherein said prescribed vibration having a phase opposite to a periodic speed change of the image carrier detected by the speed change detection apparatus.

7. A method for detecting a periodic change in speed of an image carrier, comprising the steps of:

forming a periodic latent image pattern on an image carrier;

providing an alternating current conversion type surface potential sensor;

detecting moiré appearing on the periodic latent image pattern using the alternating current conversion type surface potential sensor; and detecting the periodic latent image pattern based on the step of detecting the moiré.

* * * * *